US007219463B2

(12) United States Patent
Wössner

(10) Patent No.: US 7,219,463 B2
(45) Date of Patent: May 22, 2007

(54) METHODS AND APPARATUS TO SECURE A SAFETY CATCH IN A JAMMED POSITION

(75) Inventor: Ernst Wössner, Sulz-Holzhausen (DE)

(73) Assignee: Heckler & Koch GmbH (DE)

( * ) Notice: Subject to any disclaimer, the term of this patent is extended or adjusted under 35 U.S.C. 154(b) by 0 days.

(21) Appl. No.: 10/339,467

(22) Filed: Jan. 9, 2003

(65) Prior Publication Data

US 2003/0192222 A1 Oct. 16, 2003

Related U.S. Application Data

(63) Continuation of application No. PCT/EP02/04007, filed on Apr. 10, 2002, now abandoned.

(30) Foreign Application Priority Data

May 9, 2001 (DE) ..... 101 22 345

(51) Int. Cl.
*F41A 17/42* (2006.01)

(52) U.S. Cl. ..... 42/70.11; 89/1.4

(58) Field of Classification Search ..... 89/1.4, 89/1.42; 42/70.01, 16
See application file for complete search history.

(56) References Cited

U.S. PATENT DOCUMENTS 2,056,577 A * 10/1936 Kehne ..... 89/1.4
2,717,532 A * 9/1955 Ramseyer ..... 89/1.4
3,220,135 A 11/1965 Irusta ..... 42/70
3,225,653 A 12/1965 Packard ..... 89/1
3,255,667 A * 6/1966 Walther ..... 89/1.4
3,387,400 A * 6/1968 Badali et al. ..... 42/70.01
3,686,998 A * 8/1972 Seifried ..... 89/1.4
3,710,492 A * 1/1973 Tirrell ..... 42/16
3,847,054 A * 11/1974 Ruger et al. ..... 89/129.02
3,906,833 A * 9/1975 Orozco ..... 89/196
3,938,422 A * 2/1976 Tellie ..... 89/169

(Continued)

FOREIGN PATENT DOCUMENTS

DE 972985 10/1959

(Continued)

OTHER PUBLICATIONS

International Search Report for PCT/EP02/04007 (2 pages).

(Continued)

*Primary Examiner*—Troy Chambers
(74) *Attorney, Agent, or Firm*—Hanley, Flight & Zimmerman, LLC

(57) ABSTRACT

Methods and apparatus to secure a bolt in a jammed position are disclosed. A disclosed firearm includes a housing; a mounting bracket carried by the housing; and a cocking slide slidably engaging the mounting bracket external to the housing. The cocking slide is engageable with the bolt in order to move the bolt against the force of a closing spring and into a cocked position. In the event of a jam, the cocking slide is engageable with the bolt in order to lock the bolt in a jammed position between the fired position and the cocked position.

8 Claims, 4 Drawing Sheets

U.S. PATENT DOCUMENTS

| | | | | | |
|---|---|---|---|---|---|
| 4,024,792 | A | * | 5/1977 | Moller | 89/129.02 |
| 4,555,973 | A | | 12/1985 | Timari | 89/148 |
| 4,565,113 | A | * | 1/1986 | Bunning | 89/1.4 |
| 4,689,911 | A | * | 9/1987 | White | 42/105 |
| 4,702,144 | A | * | 10/1987 | Zedrosser | 89/1.4 |
| 4,827,652 | A | * | 5/1989 | Martin | 42/142 |
| 4,977,814 | A | * | 12/1990 | Beretta | 89/1.4 |
| 5,070,634 | A | * | 12/1991 | Marino | 42/70.01 |
| 5,179,245 | A | * | 1/1993 | Straka | 89/1.4 |
| 5,214,233 | A | * | 5/1993 | Weldle et al. | 89/1.4 |
| 5,655,326 | A | * | 8/1997 | Levavi et al. | 42/70.01 |
| 5,669,169 | A | * | 9/1997 | Schmitter et al. | 42/75.01 |
| 5,700,967 | A | * | 12/1997 | Guhring | 89/1.42 |
| 5,821,445 | A | * | 10/1998 | Guhring | 89/1.42 |
| 5,900,576 | A | * | 5/1999 | Gabriel | 89/187.01 |
| 6,019,024 | A | * | 2/2000 | Robinson et al. | 89/1.42 |
| 6,257,114 | B1 | * | 7/2001 | Murello | 89/1.42 |

FOREIGN PATENT DOCUMENTS

| | | | | |
|---|---|---|---|---|
| FR | 883590 | | | 7/1943 |
| FR | 888965 | | | 12/1943 |
| FR | 896610 | | | 2/1945 |
| GB | 1046322 | | | 10/1966 |
| GB | 2092278 | A | * | 8/1982 |

OTHER PUBLICATIONS

Folke Myrvang, *German Universal Machine Guns*, Collector Grade Publications, Inc., cover, copyright page, table of contents, and pp. 119-216 (2002).

Maschinengewehr website, http://198.144.2125/MG42/Machinengewehr%2042%20-%20Information.htm, printed Jan. 25, 2005 (5 pages).

* cited by examiner

METHODS AND APPARATUS TO SECURE A SAFETY CATCH IN A JAMMED POSITION

RELATED APPLICATION

This patent issues from a continuation application which claims priority from International Patent Application Serial No. PCT/EP02/04007 which was filed on Apr. 10, 2002 and is now abandoned.

FIELD OF THE DISCLOSURE

This patent relates generally to firearms, and, more particularly, to a firearm such as, for example, a universal machinegun, having a movable bolt and a cocking slide attached to the external side of the machinegun for selectively moving the bolt.

BACKGROUND

As used in this patent, the term "machinegun" is intended as a general term. It includes all portable self-loading firearms that have a cocking slide for manually reloading the weapon. This cocking slide may not be solidly connected with the bolt, but may instead be moved back into its resting position away from the bolt before firing a shot in order to avoid interference with the shooting process.

Positional terms such as "rear" or "top", "right" or "left" are used in this patent with reference to a weapon positioned in a shooting position, That is, with reference to a weapon positioned to shoot "forward" (i.e., away from the shooter), in a generally horizontal plane.

A machinegun of the type stated above is known from DE-PS 972 985.

The MG 42, which is still in use at the present time, is an additional example. In that weapon, the cocking slide has a loading handle. When the loading handle is in a resting position, the handle is folded up against the casing. In this position, the handle engages with a projection on the casing such that the cocking slide is clamped in place. The loading handle of the cocking slide may be folded back out of the resting position and away from the casing by being grasped and pulled by the marksman with sufficient force to release the handle from the casing. After being so released, the cocking slide may be moved rearward by means of the handle by a distance sufficient to permit the safety catch to reach the catch unit of the trigger device. If the bolt is locked in place by the catch unit of the trigger device, then the loading handle may be released and the cocking slide may then independently return back into its forward position. Once in the forward position, the handle can be folded into its resting position again. The movement of the bolt during the subsequent shooting of the weapon is, thus, not impaired by the handle.

Known light machineguns or universal machineguns, including the MG 42 noted above, often have a mechanism (the so-called "belt guiding device") for removing cartridges from the belt during the shooting process. The moving parts of this belt guiding device are seated in a cover which must be opened in order to insert the cartridge belt.

In the event of a jam, the marksman employs the cocking slide to draw the bolt rearward, returns the cocking slide to the resting position, and then attempts to resume shooting. If this is not possible, then the marksman routinely opens the cover of the belt guiding device, removes the cartridge belt, and attempts to restore the bolt of the weapon to its rearward position. The reason for the jam must then be found or eliminated.

Jams in which the bolt only moves slightly forward from its rearmost position despite an activated trigger device are possible. In such circumstances, the bolt is held in an intermediate position between its rearmost and forwardmost positions. If the marksman attempts to remove the cause of the jam, such as a foreign body, with the bolt held in an intermediate (jammed) position, then removal of the jam can release the bolt such that the bolt moves forward under spring force. The marksman can be severely injured by this sudden forward movement of the bolt.

It is particularly unpleasant if the cartridge being guided jams in such a manner that the jammed cartridge releases upon removal of the cartridge belt. In such circumstances, the bolt, which may also be released by the removal of the cartridge belt, may now move this cartridge forward and possibly fire it. Despite these potentially adverse consequences, the removal of the cartridge belt is necessary for any additional activity to un-jam the weapon.

Since the bolt is only securable by the trigger device, securing the weapon does not eliminate the problem noted above. In particular, by the time the jam occurs, the bolt has typically already left its rearmost position (i.e., the position the bolt occupies before firing the weapon), and, thus, the bolt can no longer be secured by the trigger device.

To avoid the problems noted above, the marksman must first move the bolt into its rearmost position by means of the cocking slide such that the bolt is secured by the trigger mechanism. Only after the bolt is well secured can the cover be safely opened. From time to time, however, it is not possible to move the bolt back to its rearmost position. For example, the clamping cartridge may block the belt guiding device thereby precluding rearward movement of the bolt. In particular, since the movement of the belt guiding device is coupled with the movement of the bolt, if the belt guiding device is stopped at a position, then the bolt is also prevented from moving.

Moreover, such a jam only occurs during shooting of the weapon, which may be when the machinegun is absolutely needed. The time that is available for the elimination of a jam is accordingly extremely short. There is, therefore, little sense in providing training in carrying out safe, but time-consuming, locking measures for the elimination of such a jam during peacetime, because the marksman does not in that case learn the skills that he urgently needs during actual use of the weapon in hostile situations.

With shooting weapons such as the G3 gun, for example, there is often no possibility of firmly holding the bolt in a position other than the forwardmost position. It is still possible, however, for the bolt to catch in a position to the rear of its forwardmost position during a jam. If a finger is inserted through the ejection aperture and into the weapon in order to determine the reason for a jam, and the bolt is then triggered, the finger can be clamped very badly.

BRIEF DESCRIPTION OF THE DRAWINGS

FIG. 1 illustrate the cocking slide in its resting position, with the handle in the inactive position.

FIG. 2 illustrates the cocking slide in a partially retracted position, with the handle located in the active position.

FIG. 3 illustrates the cocking slide engaging the bolt, with the handle partially folded up in the direction of its inactive position.

DETAILED DESCRIPTION

Figure 1:
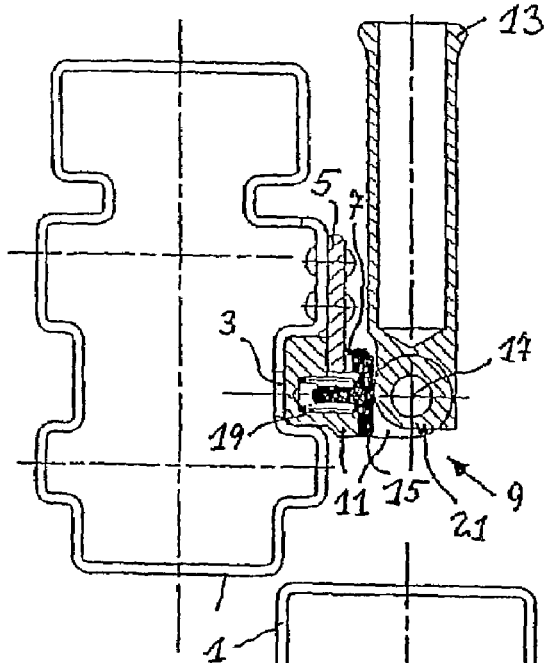
FIGS. 1–3 depict a cross-section through a casing of an example light machinegun, viewed from behind. The figures illustrate the external parts of an example cocking slide. All other parts are known to persons of ordinary skill in the art and, thus, have been omitted in order to keep the diagram easily understandable.
Figure 2:
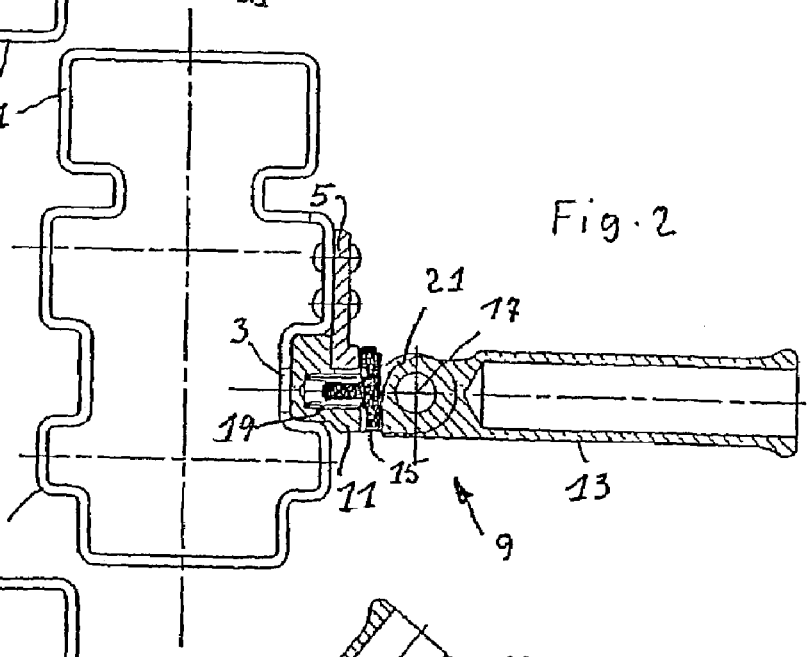
Figure 3:
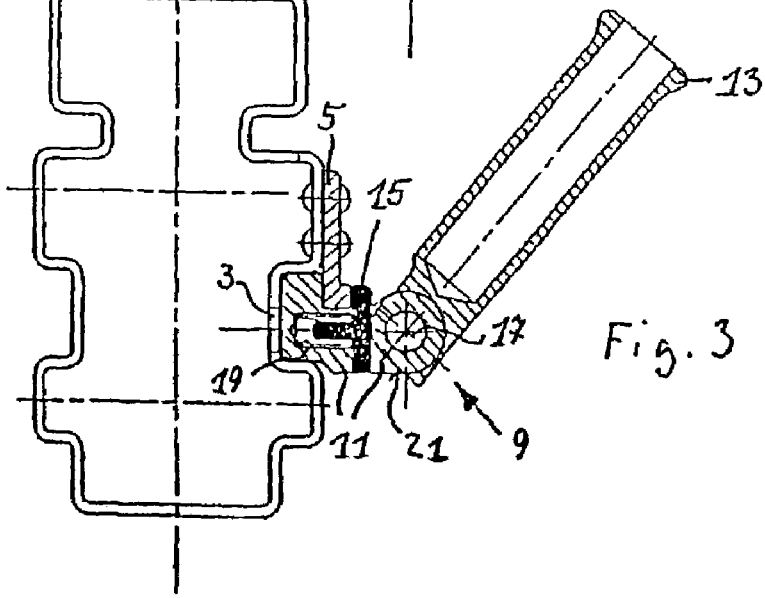

The casing (1) of the example machinegun shown in FIGS. 1–3 has the shape of a straight prism, and is molded or extruded from thin sheet metal. It has depressions or grooves positioned laterally opposite to one another, which form reinforcements. A longitudinal slot (3) is provided in the base of these grooves. As can be seen in FIGS. 2 and 3, a clamping bar (5), extends, in parallel and at a distance from this longitudinal slot (3). The clamping bar (5) is thickened at the bottom.

The clamping bar (5) is firmly riveted either to a projecting protuberance or outside the groove accommodating the longitudinal slot (3) of the casing (1). The lower thickened part reinforces the clamping bar (5), and is configured in a single part with the same. Because of its thickness, the clamping bar (5) is resistant to bending.

Figure 8:
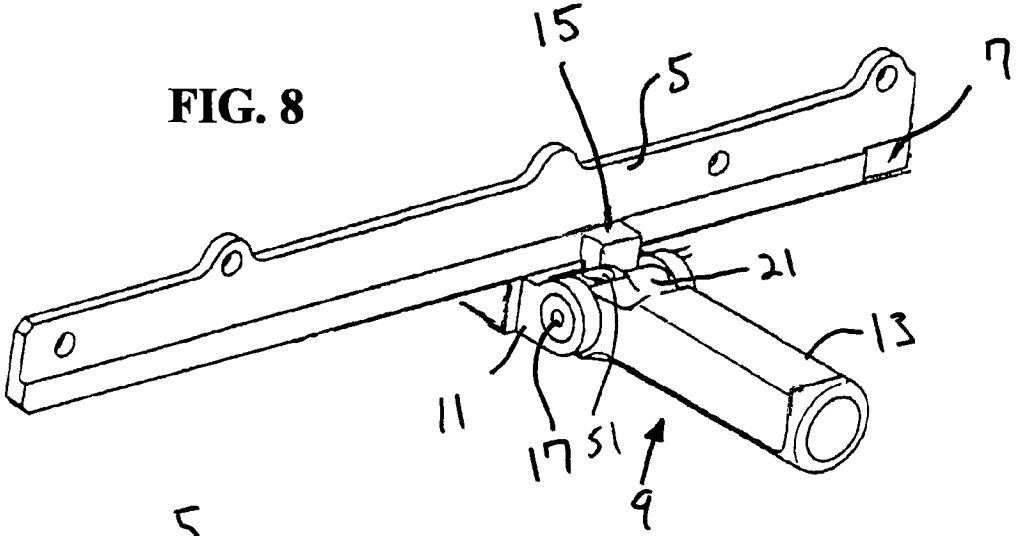
FIG. 8 is a perspective view of the example clamping bar and the example cocking slide of FIGS. 1–7.

A recess (7), which can be seen in FIGS. 1 and 8, is provided in the thickened part of the clamping bar (5). The recess (7) only penetrates the lower thicker part of the clamping bar (5).

Figure 4:
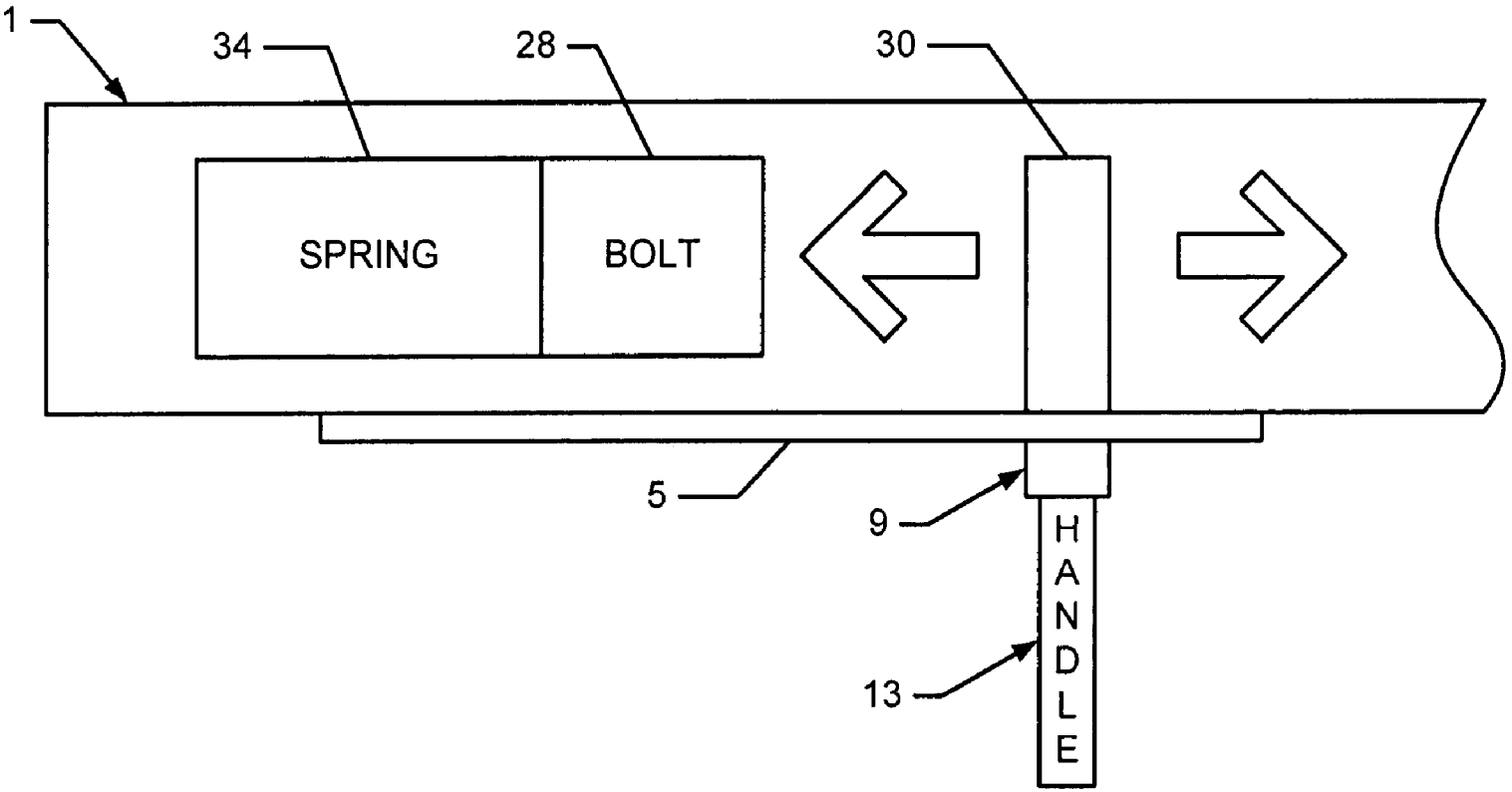
FIG. 4 is a top schematic diagram illustrating the internal components of the weapon of FIGS. 1–3, with the bolt in a jammed position.
Figure 5:
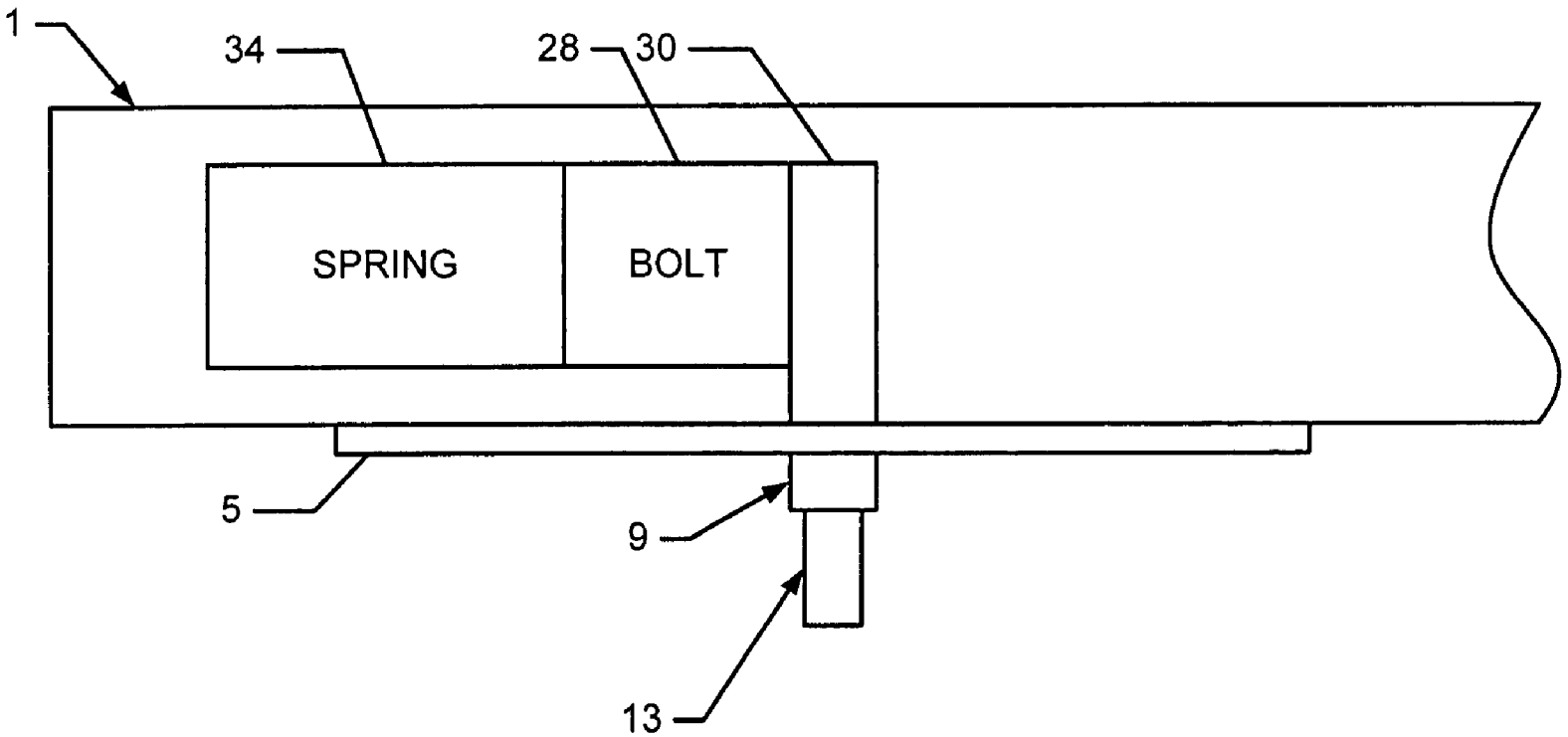
FIG. 5 is a view similar to FIG. 4, but showing the cocking slide securing the bolt in the jammed position.

A cocking slide (9) cooperates with the conventional bolt (28) of the machinegun (FIG. 4). In particular, the cocking slide (9) engages with the bolt (28) upon the retraction of the cocking slide (9) in a rearward direction, such that the cocking slide (9) may only be moved forward independently of the unjammed bolt if the bolt has locked in the conventional trigger device (not shown).

The cocking slide (9) has a sliding body (11). The sliding body (11) is movably mounted in the groove having the base defining the longitudinal slot (3). The sliding body (11) engages with the clamping bar (5), so that the sliding body (11) cannot fall out of the groove. The sliding body (11), moreover, has a catch unit (30) for engaging the bolt (28). The catch unit (30), like the bolt 28 and the trigger device, is a conventional device which is well known to persons of ordinary skill in the art. The catch unit (30) may simply be a bar that extends into the travel path of the bolt (28) to prevent the bolt (28) from moving forward without a corresponding forward movement of the cocking slide (9) when the cocking slide (9) and the bolt (28) are engaged.

Figure 6:
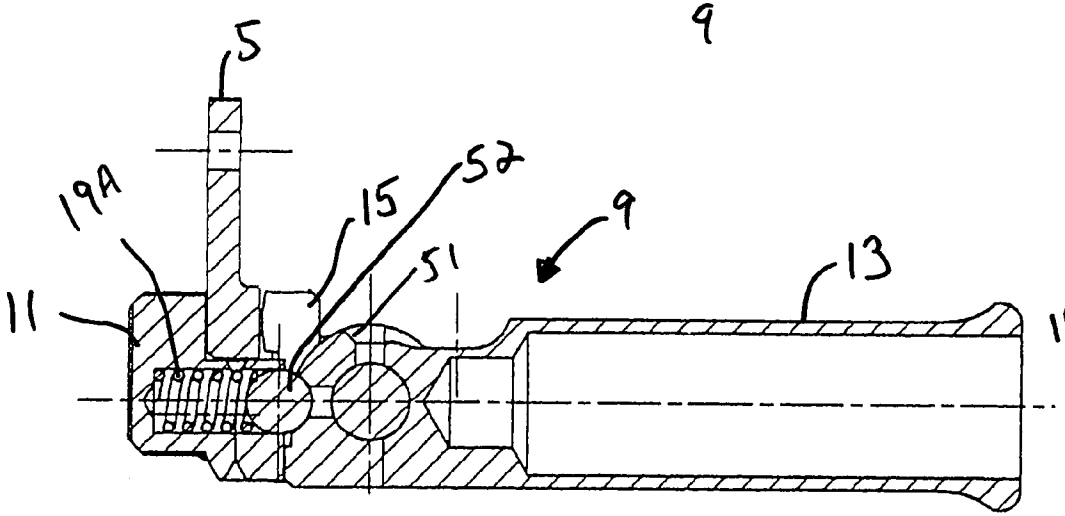
FIG. 6 is an enlarged view of a portion of FIG. 2, but showing the example ball and detent arrangement as described in the specification.

The sliding body (11) protrudes laterally and outwardly from under the clamping bar (5). The outer end of the sliding body (11) is branched. Both of the side plates of this branched end are penetrated by a pivoting axis (17). The pivoting axis (17) extends in parallel to the longitudinal slot (3) of the weapon and to the clamping bar (5). The cocking slide (9) includes a straight, largely hollow loading handle (13). One end of the loading handle (13) is supported in a swivelable manner on the pivoting axis (17). The end of the handle (13) supported on the axis (17) includes a curved part (21). This end of the handle (13) also has two catching depressions (51) (see FIGS. 6–7). A spring (19A) with an engaging ball (52) is seated in the sliding body (11). The positional coordination of the engaging ball (52) and the catching depressions (51) is such that the handle (13) can be firmly engaged, both in a vertical position (see FIGS. 1 and 7) and in a horizontal position (see FIGS. 2 and 6). When the engaging ball (52) engages a depression (51), the handle (13) is positioned either upwardly (e.g., the inactive position shown in FIGS. 1 and 7) or to the side (e.g., the active position shown in FIGS. 2 and 6).

A clamping part (15) is seated in a boring inside the sliding body (11). The clamping part (15) can be pressed against the action of a spring (19) toward the casing (1). The curved part (21) of the handle (13), which functions as an eccentric cam, is located opposite to the clamping part (15). If the handle (13) is swiveled into the vertical (inactive) position, then the curved part (21) presses the clamping part (15) inward toward the casing (1).

Figure 7:
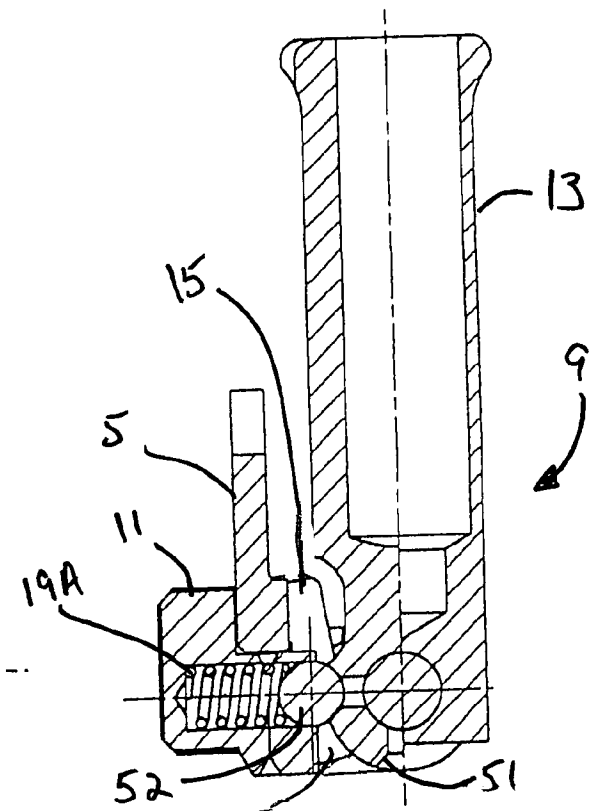
FIG. 7 is an enlarged view of a portion of FIG. 1, but showing the example ball and detent arrangement as described in the specification.

The clamping part (15) has a flat, disk-shaped head which, in the inactive position of the cocking slide (9) (FIG. 1), drops into the recess (7) of the clamping bar (5). At the same time, the engaging ball (52) holds the handle (13) solidly in the inactive position, pointing vertically upward as shown in FIGS. 1 and 7. The cocking slide (9) occupies this position in its resting position, that is to say, during shooting or transport of the weapon. The handle (13) does not, have to be folded up when using the weapon (e.g., during firing and/or transport), but folding the handle (13) into the inactive position may be advantageous during such use.

For reloading, the handle (13) of the cocking slide (9) is folded into its horizontal (active) position (see, for example, FIGS. 2 and 6), in which it firmly locks. The curved part (21) is formed such that, when the handle (13) is in the active position, the clamping part (15) is moved away from the casing (1) by the spring (19). Thus, the clamping part (15) is located further away from the casing (1) when the handle (13) is in the active position than when the handle (13) is folded-up into the inactive position of FIG. 1. The disk-shaped head of the clamping part (15) moves outwardly relative to the recess (7) when the handle (13) is moved from the inactive position toward the active position so that the cocking slide (9) may be moved back and forth without impediment.

If a jam occurs during shooting (i.e., with the cocking slide (9) located in the resting position of FIG. 1), such that, after leaving its rearmost position, the bolt (28) is firmly held in an intermediate position, then the handle (13) of the cocking slide (9) may be moved out of its inactive position (e.g., the position of FIG. 1) and into its active position (e.g., the position of FIG. 2). The cocking slide (9) may then be moved back until the catch unit (30) solidly impacts on the bolt (28). After this engagement, the handle (13) is swiveled upwardly as far as possible, so that the curved part (21) presses the clamping part (15) in the direction of the casing (1) and the handle (13) occupies the position depicted in FIG. 3.

Since the recess (7) is located in the forward end of the clamping bar (5), the clamping part (15) does not engage the recess (7) in the position shown in FIG. 3. Instead, the lower part of the thickened part of the clamping bar (5) is tightly clamped between the head of the clamping part (15) and the part of the sliding body (11) positioned opposite to it. The slide body (11) is, thus, locked in place by the compressive force applied by the curved part (21) of the handle (13). Since the slide body (11) is coupled to the bolt (28) via the catch unit (30), the bolt (28) is also locked in the intermediate position in which it was arrested when the jam occurred. More specifically, the slide body (11) is secured at the clamping bar (5) which directs all stresses over its length into the casing (1). The cover of the cartridge belt may, thus, be safely opened and the jam removed without fear that the bolt (28) will move when the jam is cleared. Instead, the bolt (28) is held in position until the handle (13) is pivoted toward the active position (e.g., toward the position of FIG. 2) to intentionally release the same.

In the illustrated example, the gradient of the curve of the curved part (21) must be relatively small compared with a circular arc around the pivoting axis (17), so that the handle (13) remains in a position such as that shown in FIG. 3, and does not pivot back into a horizontal position such as that shown in FIG. 2, after the slide body (11) and the bolt (28) are locked in place as explained above. This must also be the case if the clamping bar (5) and the sliding body (11) are moist or lubricated.

After the jam is removed, the handle (13) may be swiveled into the horizontal, active position again. The cocking slide (9) may then be moved rearward until the bolt (28) is secured in place by the trigger device. The cocking slide (9) may then be moved forward or, depending on the manner of loading of the machinegun, it is allowed to move forward together with the bolt (28). As a result, the cocking slide (9) finally occupies its resting position, and the handle (13) is swiveled upwardly and firmly engaged in the inactive position. A cartridge belt may then be inserted, and the cover of the belt guiding device may then be closed, so that the machinegun is—after the renewed retraction of the cocking slide (9), if necessary—ready for shooting again.

From the foregoing, persons of ordinary skill in the art will appreciate that an example self-loading firearms have been disclosed in which jams of the stated type can be rapidly and securely eliminated. In particular, an illustrated example weapon having a bolt (28) is provided with a cocking slide (9) that can be locked with the bolt (28) in virtually any position in which the bolt (28) is arrested in the event of a jam. The engagement of the cocking slide (9) and the bolt (28) prevents the cocking slide (9) from moving in the direction of its resting position or firing position, thereby ensuring the bolt (28) does not move when the jam is removed until the cocking slide (9) is manipulated to intentionally release the bolt (28).

The illustrated bolt (28) can, therefore, not only be locked in its forward resting position, or in its cocked, rear position, or in a defined intermediate position, such as is already known, it can, instead, also be locked in practically every position that it can occupy between its end positions. This is significant since, at least in theory, the bolt (28) may be arrested in any position over the entire range of its movement by a jam. The cocked position, which the bolt (28) of a weapon occupies if the bolt (28) is held by the trigger device, is understood to be one of the end positions.

If a jam of the type described occurs, then the cocking slide (9) is moved out of its resting position until the catch unit (30) of the cocking slide (9) impacts against the arrested bolt (28). The cocking slide (9) then secures the bolt (28) at that position by means of the catch unit (30). All measures for the elimination of the jam (e.g., opening of the cover, removal of the cartridge belt, removal of a somewhat deformed cartridge, etc.) can now be carried out without fear of movement of the bolt (28). The danger of, for example, the bolt (28) being accidentally struck, the marksman being injured, or of a cartridge that has remained in the weapon being fired upon removal of the jam is eliminated.

If no shot occurs after activation of the trigger, the marksman grabs the cocking slide (9). If, upon activation of the cocking slide (9), the marksman feels that the cocking slide (9) can be moved without resistance over a portion of the path of its movement, then he already knows that the bolt (28) has caught. When, upon moving rearwardly, the cocking slide (9) encounters resistance, the cocking slide (9) is activated to lock the bolt (28) in place so that the disturbance can be eliminated. When the cocking slide (9) is so locked, the bolt (28) cannot move from its current position.

After the elimination of the disturbance, the cocking slide (9) may be unlocked, the bolt (28) may be moved back to its cocked position, the cartridge belt may be inserted, the cover may be closed, and the cocking slide (9) may be moved back into its resting position again, just as after reloading.

The cocking slide (9) may be moved generally parallel to the direction of shooting and attached laterally to the weapon, as is the case in the above-stated MG 42. The cocking slide may, however, alternatively be attached above, under, in front of, or behind the path of movement of the bolt (28). It can also be configured as a crank. The cocking slide (9) is movable, is equipped with an activation device such as a handle (13), and has a resting position at one end of its path of movement.

In this resting position, the illustrated cocking slide (9) may lock the bolt (28) by swiveling the handle (13). Outside of its resting position, the clamping part (15) may be activated by swiveling the handle (13) of the cocking slide (9). The cocking slide (9) and the catch unit (30) may be unlocked for movement by swiveling the handle (13) back towards the active position.

In the known MG 42, as already noted above, the handle of the cocking slide can also be swiveled into its forward resting position in order to lock it. The carrying out of a swiveling movement of the handle on the cocking slide is, thus, entrusted to the marksman. In the example weapon illustrated herein, this same movement of the handle (13) is additionally used in order to lock and unlock the cocking slide (9) outside of its resting position. The catch unit (30) is, thus, releasable via the handle (13) of the cocking slide (9). The handle (13) also serves to lock the cocking slide (9) in its resting position.

The example machinegun shown in FIGS. 1–8 could, as is known, have a loading crank, such as a cocking slide, for example. Preferably, however, the machinegun has a casing (1) with a longitudinal slot (3), such as is the case in the majority of light machineguns A rigid clamping bar (5), to which the cocking slide (9) can be tightly clamped in every position, is positioned adjacent the longitudinal slot (3). The clamping bar (5) forms a stiffening of the casing (1) adjacent the longitudinal slot (3). That is to say, the casing (1) is strongly stressed at the location of this longitudinal slot (3). If the cocking slide (9) were locked somewhere in the longitudinal slot (3) by the clamping part (15), then the casing (1) could be bent if sufficient force were applied through the cocking slide (9). The casing (1) is simply not designed to absorb considerable transverse forces in the area of the longitudinal slot (3).

This clamping bar (5) has a recess (7), preferably at the location of the resting position of the cocking slide (9), so that when the cocking slide (9) is located in the resting position, it is impeded from rearward movement by the clamping bar. As a result, the clamping bar (5) absorbs forces that are applied to the weapon by the cocking slide (9) if the cocking slide (9) encounters external forces when it is located in its resting position (e.g., upon dropping the weapon). In this way, a separate reinforcement on the casing (1) at the point of the resting position can be avoided.

Although the illustrated cocking slide (9) includes a pivotable handle (13), it may alternatively have an immovable handle, and a second movable handle for the clamping part (15).

The example machine gun illustrated herein has a cocking slide (9) with a handle (13) which can be swiveled between an active position and an inactive position. It also includes a clamping part (15) that fixes the cocking slide (9) in each of these positions. In the inactive position, the illustrated cocking slide (9) is folded up against the casing (1) while, in the active position, the illustrated cocking slide (9) protrudes in such a manner that it can be grasped and activated in a forceful manner.

The clamping part (15) may be configured in multiple ways. The clamping part (15) may, for example, engage in a counter-construction in a form-locking manner. For this purpose, a series or a chain of counter-constructions can be configured, one after the other, on the casing (1) or on the clamping bar (5).

A force-locking engagement is, however, preferred, since, with a force-locking engagement, the points of engagement of the clamping part (15) follow continuously one after the other. It is preferred for the handle (13) to have an eccentric cam or a curved part (21) which can be pressed against the clamping bar (5) by swiveling the handle (13), or can be pressed against a movable clamping part (15) which tightly clamps the clamping bar (5) between itself and a part of the cocking slide (9).

Neither the eccentric cam (21) nor the clamping part (15) has any effect on the location of the resting position of the cocking slide (9), since the clamping bar (5) is either interrupted there (in the case of, for example the recess (7)) or is not present. The clamping part (15) described above reliably holds the handle (13) in the inactive position if the handle (13) is completely folded up against the casing in the resting position. Outside the resting position, on the other hand, the handle (13) can only be partially folded against the casing (1), because of the clamping bar (5). The clamping part (15) does not then come in to effect in securing the cocking slide (9) in places other than the resting position.

Upon a jam of the type described above, the cocking slide (9) is first moved into the active position such that the handle (13) protrudes outward from the casing (1). The cocking slide (9) is then moved back, such as upon reloading, but only a distance sufficient to engage the bolt (28) in its arrested position intermediate the fired position and the cocked position. The handle (13) is then swiveled out of its active position in the direction of its inactive position. It cannot entirely achieve this, however. That is to say, the eccentric cam (21), or the clamping part (15) stressed by the cam (21), is moved forward into solid engagement with the clamping bar (5). A part of the cocking slide (9) preferably forms a counter-support unit.

The eccentric cam (21) is thereby designed in such a manner that it is self-catching, and, thus, only detaches from clamping engagement with the bolt (28) if the handle (13) is swiveled back toward its active position again. In contrast to the known MG 42 noted above, however, the swiveling movement of the handle (13) takes place transversely to the direction of the movement that it carries out upon reloading, and thus mostly transversely to the longitudinal direction of the weapon. The handle (13) is, therefore, folded downwardly or, preferably, upwardly. The two movements of the reloading, on the one hand, and of the activation or the detachment of the clamping part (15), on the other hand, are consequently not impaired, since they take place generally perpendicularly to one another.

From the foregoing, persons of ordinary skill in the art will readily appreciate that firearms have been disclosed which include a cocking slide that can be moved to engage with a bolt in order to secure the bolt against the force of a closing spring (34) in a jammed position intermediate a resting/fired position and a cocked position.

Although certain example methods and apparatus have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A firearm having a movable bolt biased toward a fired position by a closing spring, the firearm comprising:

a housing;

a mounting bracket carried by the housing;

a cocking slide slidably engaging the mounting bracket external to the housing, the cocking slide being engageable with the bolt in order to move the bolt against the force of the closing spring and into a cocked position, and, in the event of a jam holding the bolt in a jammed position between the fired position and the cocked position, the cocking slide also being engageable with the bolt and securable to the mounting bracket in order to lock the bolt in the jammed position, wherein the cocking slide further includes a handle, and wherein the handle is pivotable between an inactive position and an active position.

2. A firearm as defined in claim 1 wherein the handle includes a camming surface to lock the cocking slide when the handle is pivoted toward the inactive position.

3. A firearm as defined in claim 2 wherein the camming surface is part of an eccentric cam.

4. A firearm having a movable bolt biased toward a fired position by a closing spring, the firearm comprising:

a housing;

a mounting bracket carried by the housing;

a cocking slide slidably engaging the mounting bracket external to the housing, the cocking slide being engageable with the bolt in order to move the bolt against the force of the closing spring and into a cocked position, and, in the event of a jam holding the bolt in a jammed position between the fired position and the cocked position, the cocking slide also being engageable with the bolt and securable to the mounting bracket in order to lock the bolt in the jammed position, wherein the cocking slide further includes a handle, wherein the cocking slide has a resting position, and the cocking slide is secured in the resting position by swiveling the handle to a predefined position.

5. A firearm as defined in claim 4 wherein the cocking slide locks the bolt in response to swiveling of the handle through an angle in a first direction when the cocking slide is located outside of the resting position.

6. A firearm as defined in claim 5 wherein the cocking slide unlocks the bolt in response to swiveling of the handle through the angle in a second direction opposite the first direction.

7. A firearm as defined in claim 4 wherein swiveling the handle occurs substantially transversely to a direction of movement of the cocking slide.

8. A firearm having a movable bolt biased toward a fired position by a closing spring, the firearm comprising:

a housing;

a mounting bracket carried by the housing;

a cocking slide slidably engaging the mounting bracket external to the housing, the cocking slide being engageable with the bolt in order to move the bolt against the force of the closing spring and into a cocked position, and, in the event of a jam holding the bolt in a jammed position between the fired position and the cocked position, the cocking slide also being engageable with the bolt and securable to the mounting bracket in order to lock the bolt in the jammed position, wherein the cocking slide includes a clamping part, and wherein the mounting bracket is clamped between the clamping part and a portion of the cocking slide when the cocking slide is secured to the mounting bracket.

* * * * *